United States Patent [19]

Lawrence et al.

[11] 4,019,166

[45] Apr. 19, 1977

[54] TIMER CONTROLLED ELECTROMAGNETIC TRIPPING APPARATUS FOR SIMULTANEOUSLY CLOSING PLURAL SWITCHES MOUNTED TO PANELBOARD

[75] Inventors: Robert J. Lawrence, Dix Hills; John Devaney, Massapequa Park; Dominick Tramontano, East Islip, all of N.Y.

[73] Assignee: Grumman Aerospace Corporation, Bethpage, N.Y.

[22] Filed: Mar. 10, 1975

[21] Appl. No.: 557,034

[52] U.S. Cl. ..... 335/172; 200/18; 200/330; 335/8

[51] Int. Cl.[2] ..... H01H 9/00; H01H 3/00

[58] Field of Search ..... 200/1 R, 1 V, 5 R, 5 B, 200/5 C, 5 E, 5 EA, 18, 33 R, 42 T, 50 C, 296, 329, 330, 331, 335, 337; 335/1, 2, 8, 26–28, 30, 68, 132–138, 159–161, 167–173

[56] References Cited

UNITED STATES PATENTS

| | | | |
|---|---|---|---|
| 3,365,555 | 1/1968 | Ponsy | 200/5 E |
| 3,367,193 | 2/1968 | Rose | 200/5 R X |
| 3,582,579 | 6/1971 | Ford et al. | 200/18 |
| 3,742,172 | 6/1973 | Velez | 200/330 |
| 3,889,088 | 6/1975 | Zdanys et al. | 200/18 X |

*Primary Examiner*—James R. Scott
*Attorney, Agent, or Firm*—Morgan, Finnegan, Pine, Foley & Lee

[57] ABSTRACT

A device adapted to be mounted on an existing multi-switch panel includes a plurality of spring biased trip rods which are adapted to engage the switch levers to move them to the OFF position when released. The rods are moved conjointly with the switches when the switches are turned to the ON position. Flexible detents block the return of the rods in the OFF direction until displaced by a single actuator rod operated by a programmed timer.

10 Claims, 8 Drawing Figures

TIMER CONTROLLED ELECTROMAGNETIC TRIPPING APPARATUS FOR SIMULTANEOUSLY CLOSING PLURAL SWITCHES MOUNTED TO PANELBOARD

The present invention relates to switching mechanisms and in particular to programmable ganged switching mechanism for switch panels, circuit breakers or the like.

BACKGROUND OF THE INVENTION

With the ever increasing concern for energy conservation, particularly the conservation of electrical power, a need has developed for energy conservation systems which can be readily and economically incorporated into present electrical circuits.

Industrial plants have a wide variety of electrical energy consuming systems, which are not turned off, when out of use or not needed; resulting in inefficient use and sometimes waste of electricity. Such systems include electrical fans; signs and lighting circuits. Advantageously, conservation systems should be relatively inexpensive, easily maintained, programmably flexible and readily adapted to incorporation into existing circuits.

Existing methods of conservation require programmable functions to be originally designed into the wiring systems or circuit breakers, involve costly modifications and/or addition of relays or contactors to the electrical switching systems.

Various mechanisms have been proposed in the past for operating switching devices. Ganged switching devices include: Hewlett et al., U.S. Pat. No. 829,785; Thurston Re. U.S. Pat. No. 16,810, Burnham, U.S. Pat. No. 1,741,824 and Walle, U.S. Pat. No. 1,760,532. None of these mechanisms, however, are readily adaptable for use with existing switch panels.

Single switch mechanisms have also been proposed. However, none of these are readily adapted for ganged switching in existing systems. Doty, U.S. Pat. No. 2,171,267 relates to a wall switch control unit wherein energy is stored in a coil spring for returning the switch to the ON position. The spring drives a rod when released by a complex linkage system having a detent and lock mechanisms. The linkage is operated by a pair of solenoid relays through a camming action on the locking mechanism. Loffler et al. U.S. Pat. No. 3,736,054 also shows a dual solenoid actuator for a single switch.

Kiesel et al., U.S. Pat. No. 3,296,565 and DeVisser et al., U.S. Pat. No. 3,778,633 both illustrate motor driven, worm gear switch mechanism, the former being for a single switch and the latter being for a special pair of circuit breakers.

One of the most practical methods of conserving electrical power is to control the master panel, e.g., circuit breaker or switch panels which contain a plurality of branch circuit switches for plant lighting and other equipment.

SUMMARY OF THE INVENTION

The present invention relates to a low cost switch mechanism which is easily installed on existing multi-switch panels. The device includes a housing from which a plurality of trip rods extend. The rods are engageable with the switches to move them to the OFF position, and are spring loaded when moved conjointly with the associated switch to the ON position. Each rod is maintained in a cocked position by a flat leaf spring. At preselected times, e.g., at plant closing time, all the leaf springs are displaced by the movement of a single actuator rod, and the trip rods return the switches to the OFF position. Subsequent to each operation of the invented mechanism, any number of the individual branch circuit switches may be manually returned to the ON position without the necessity of turning all circuits ON as would be the case when all circuits in any facility are controlled by one master switch or contactor. Consequently, a conservation of electrical energy is effected.

DETAILED DESCRIPTION OF A PREFERRED EMBODIMENT

Figure 1:
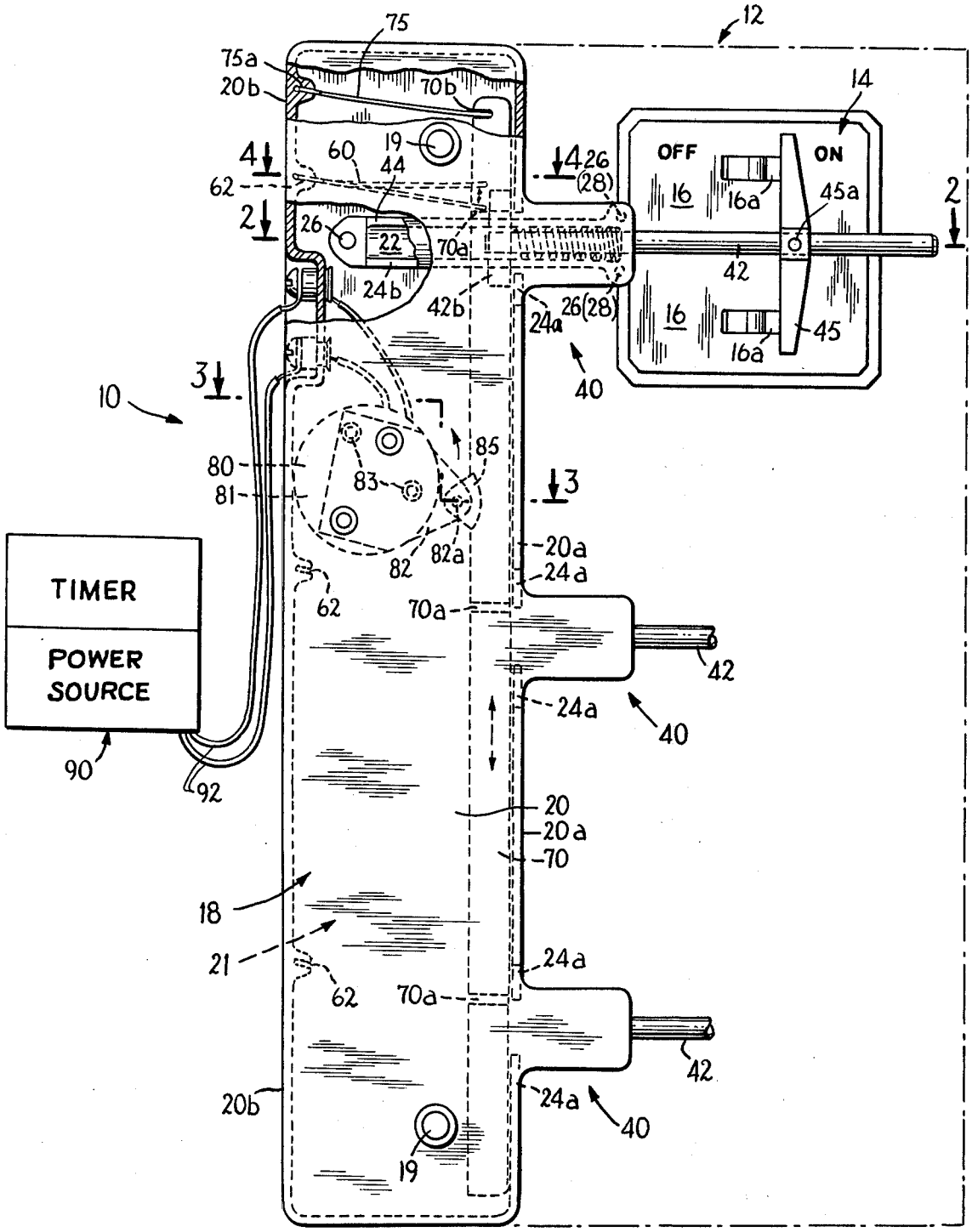
FIG. 1 is a fragmentary front elevation view, of a switching device in accordance with the present invention installed on a circuit breaker panel.

While this invention is susceptible of embodiment in many different forms, there is shown in the drawings and will hereinafter be described in detail a preferred embodiment of the invention, with the understanding that the present disclosure is to be considered as an exemplification of the principles of the invention and is not intended to limit the invention to the embodiment illustrated.

FIG. 1 illustrates the switching device 10 of the present invention installed on a circuit breaker or switch panel 12, having multiple pairs 14 of electrical switches 16 (only one pair being illustrated). The device includes a two piece housing 18 which is attached to the existing panel 12 by fasteners 19.

Figure 2:
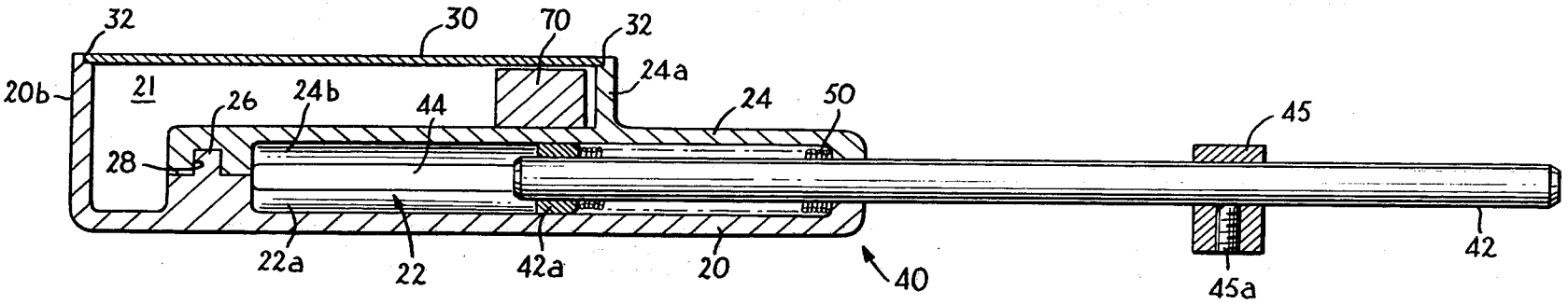
FIG. 2 is an enlarged sectional view taken along line 2—2 in FIG. 1 illustrating a trip assembly.

Housing 18 may be formed of any suitable material as by molding and preferably is injection molded of plastic. Housing 18 includes a main body portion 20 defining a generally T-shaped cavity 21 within which the trip mechanisms 40, discussed below, are located, FIGS. 2–4. At spaced locations within portion 20 are transverse trip actuator guide channels 22 defined by a pair of wall portions 22*a* extending from body portion 20. A complementary trip actuator cover 24 overlies each pair of wall portions 22*a* and is interlocked therewith by mating projections 26 on the body portion and holes 28 in the cover. Each cover 24 includes a wall portion 24*a* which interfits with wall portion 20*a* to form an essentially continuous wall on the right side of the housing, as viewed in FIG. 1. The cavity 21 is closed by a cover plate 30 which is snap fit into a groove 32 in the wall portions 20*a* and 20*b* of the housing.

Each trip mechanism 40 includes a trip rod 42 slidably positioned with the housing in channel 22 and extending outwardly therefrom along a path parallel to and between the associated pair of switches 16. Each rod 42 is guided within channel 22 by a guide member 42*a* attached to the inner end of the rod. Guide member 42*a* has a pair of diametrically opposed vanes 42*b*. Each vane is positioned in sliding relationship in a slot 44 defined by wall portions 22*a* and 24*b*. Each slot extends from the base of channel 22 to the inside surface of wall 24*a*, see FIGS. 2 and 4.

Each rod 42 is biased inwardly of housing 20 by a compression spring 50 positioned coaxially about the rod and between guide member 42*a* and outer end of channel 22. In this manner, as rod 42 is moved to the right, the spring is compressed to provide stored energy for operating switches 16.

Switches 16 are of the lever actuated or toggle type in which the switch is turned ON or OFF by movement of the switch lever 16*a*. The present invention is designed for turning the switches OFF when the circuits controlled thereby are not in use. To this end, a lever engaging member 45 in the form of a butter-fly link is attached to rod 42 and adjustably secured by fastener 45*a*. The wings of member 45 contact the levers 16*a* of the associated pair of switches on the ON side thereof and thus will move the lever 16*a* to the OFF position as the rod 42 is biased inwardly by spring 50. It will be appreciated that spring 50 is of sufficient strength to overcome the spring loading normally incorporated in toggle switch but can be easily compressed when the lever 16*a* (and rod 42) is moved manually to the ON position. The throw of each trip rod corresponds to the throw of the associated switches. The throw of the rods may be the same or different to accommodate switches having different throw.

Figure 4:
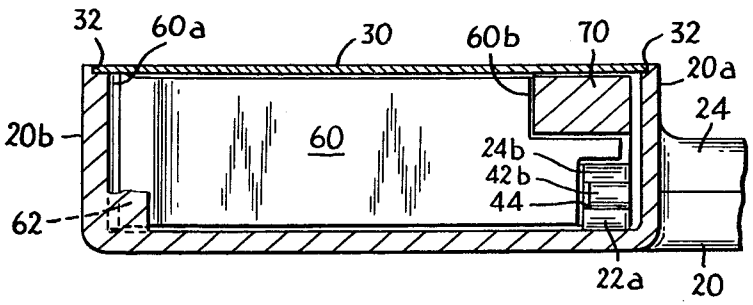
FIG. 4 is an enlarged fragmentary sectional view taken along line 4—4 in FIG. 1 illustrating the resilient detent.

To maintain the trip rod in the ON position, a flexible, detent 60, FIG. 4, is utilized. Each detent 60, one for each rod, is preferably a flat spring having a bulbous portion 60*a* at one end to facilitate mounting the spring in mounting slot 62 formed in the interior of housing wall 20*b*. With particular reference to FIG. 1, slot 62 is skewed at an angle from wall 20*b* to assure that the spring 60 is normally oriented into a blocking position against one of the vanes 42*b*, thereby interfering with and blocking the return movement of rod 42, FIG. 4.

All the detent springs 60 are moved to a clearance position by an elongate actuator rod 70 which overlies and traverses the free ends of the detents. Rod 70 includes detent engaging ribs 70*a* located adjacent the detents which contact and move the associated detent when the rod is moved upwardly, as viewed in FIG. 1.

Rod 70 slides on covers 24 and between wall 20*a* and a cut out 60*b* in spring 60. A return spring 75, FIG. 1 similar to detents 60 but without cut-out 60*b* may be provided to assist in biasing the rod downwardly to an inactivate position. Spring 75 is positioned in a skewed slot 75*a* formed on the interior of wall 20*b* at one end, and the other end is located in a slot 70*b* in rod 70.

Figure 3:
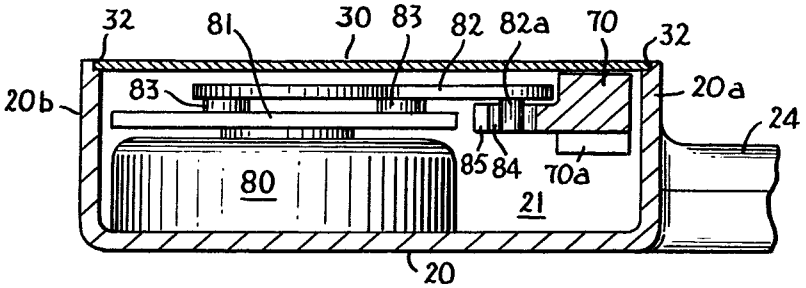
FIG. 3 is an enlarged fragmentary sectional view taken along line 3—3 in FIG. 1 illustrating the solenoid drive.
Figure 5:
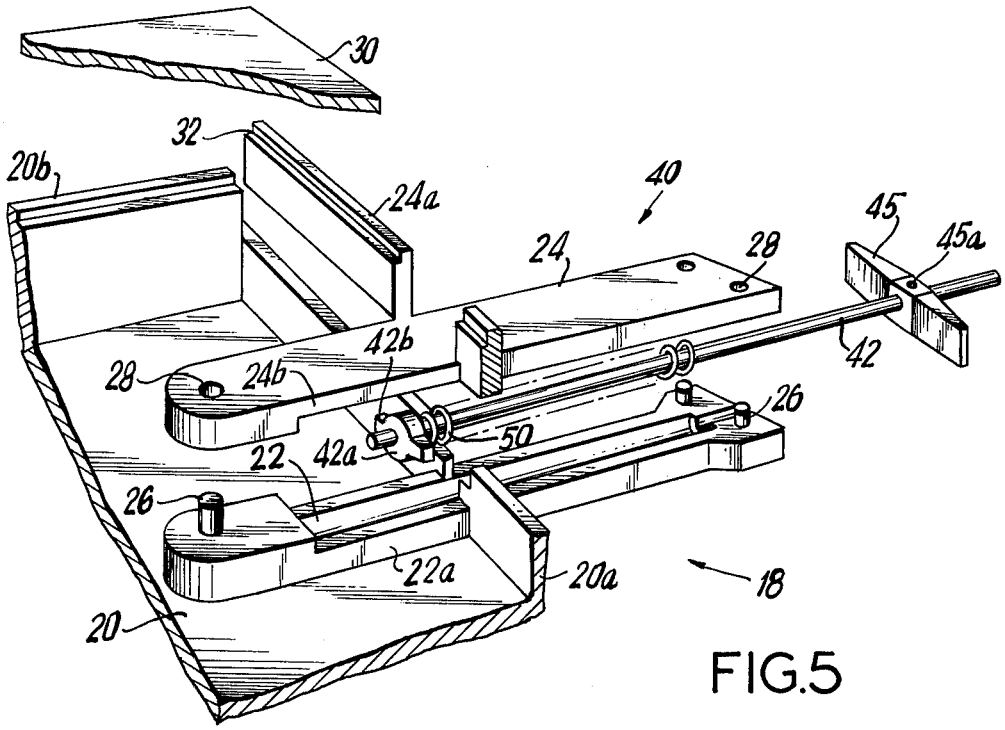
FIG. 5 is an exploded, fragmentary perspective view of the switching device.
Figure 6A:
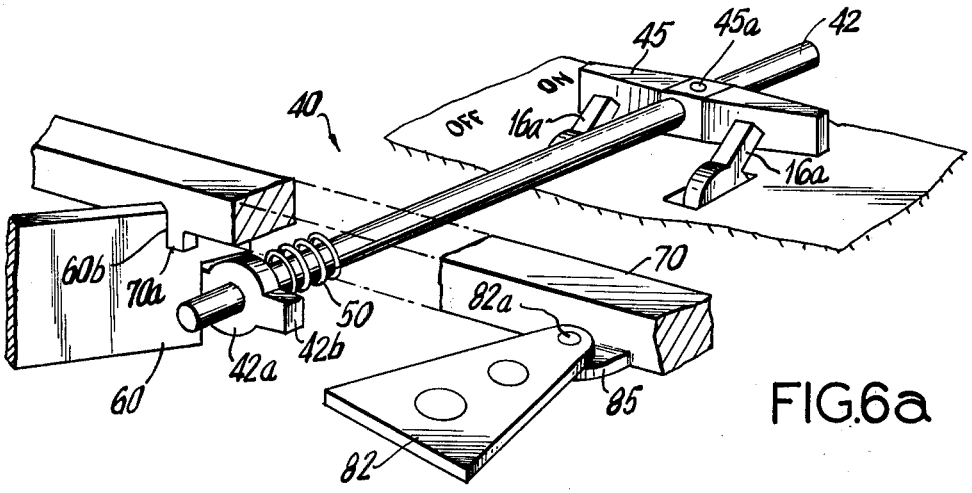
FIGS. 6*a* and 6*b* are fragmentary, perspective views illustrating the interaction of the switching device elements in ON and OFF positions, respectively.
Figure 6B:
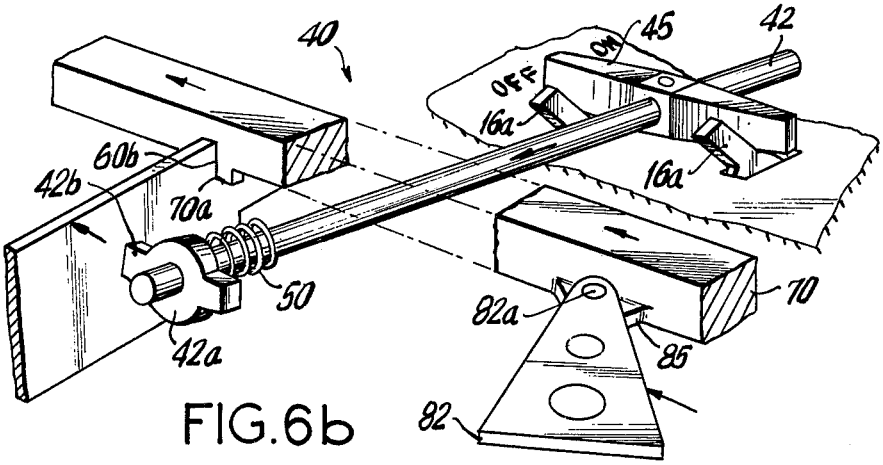

With reference to FIG. 3, rod 70 is moved to an active, detent release position by means of a 24 V.D.C. rotary solenoid 80 which delivers a one way pulse type pivot of about 25° to release the detents. This type of solenoid is available commercially from Ledex, Inc., of Dayton, Ohio. Solenoid 80 drives a plate 81 which is fastened to an overlying actuator plate link 82 by fasteners 83. Plate 82 in turn is coupled to rod 70 by means of a depending pin 82*a*, which is located in a hole 84 in a flange 85 extending from rod 70. Hole 84 has lateral clearance such that the angular movement of pin 82*a* results in only linear motion of rod 70. It will be appreciated that plates 81 and 82 may be integrated i.e. formed of a single plate.

Solenoid 80 is itself powered from a remote source and timer 90 through lines 92. Timer 90 may be set for any convenient time, e.g. store or plant closing, to automatically shut off all the circuits controlled by the panel 12. It will also be appreciated that each switch 16 may be operated manually independently of the trip mechanism when the rod is cocked in the ON position.

From the above description it will be apparent that the present invention provides an economical mechanism which can be readily incorporated into existing electrical systems without modification to the circuitry and can be easily removed if desired.

What is claimed is:

1. A switching device for use with a switch panel having a plurality of lever type switches therein comprising:

housing means adapted to be mounted on the panel adjacent the switches; a plurality of trip assemblies, each assembly including a trip rod slidably mounted in said housing and extending outwardly therefrom parallel to the throw path of the associated panel switches; switch lever engaging means coupled to said trip rod, said trip rod being movable through a throw distance corresponding to the ON-OFF throw of said switch lever; spring means mounted in said housing for biasing said trip rod to the OFF position; flexible detent means located within said housing having one portion normally engaging the trip rod and blocking the movement thereof in the OFF direction, and said one portion being movable to a non-blocking position, whereby said trip rod may move in the OFF direction under the influence of said spring means, each trip rod and engaging means being movable conjointly with their associated switch lever, when the switch lever is manually moved to the ON position; and an elongate actuator rod slidably mounted in said housing and traversing each detent means, said actuator rod including a detent engaging member for each flexible detent; and means for moving said actuator rod longitudinally to cause said detent engaging member means to flex each detent means whereby said one portion of the detent means is moved to a non-blocking position and each rod is biased to the OFF position.

2. The device of claim 1, wherein each of said flexible detent means is a leaf type spring, one end of the spring being attached to the housing and the other end being free and located in the path of said trip rod.

3. The device of claim 1, wherein said trip rods are biased inwardly of the housing means.

4. The device of claim 1, wherein one of said switch lever engaging means is adapted and arranged to engage a plurality of adjacent switch levers on the panel.

5. The device of claim 1, wherein said switch lever engaging means are adjustably secured on said trip rods.

6. The device of claim 1, wherein the throw of each trip rod is the same to accommodate a plurality of switches having the same throw.

7. The device of claim 1, wherein the throws of the trip rods are different to accommodate switches having different throw distances.

8. The device of claim 1, wherein said actuator rod moving means includes a rotary solenoid, and linkage means for transforming the rotary motion of the solenoid into linear motion for moving said actuator rod.

9. The device of claim 8, further including timer means for actuating said solenoid at predetermined times.

10. The device of claim 1, further including spring means for biasing said actuator rod longitudinally in a direction opposite to the detent release direction.

* * * * *